US007719493B2

(12) United States Patent
Huang

(10) Patent No.: US 7,719,493 B2
(45) Date of Patent: May 18, 2010

(54) DATA DRIVING CIRCUIT OF DISPLAY DEVICE

(75) Inventor: Hui-Ya Huang, Tainan Hsien (TW)

(73) Assignee: Au Optronics Corp., Hsinchu (TW)

( * ) Notice: Subject to any disclaimer, the term of this patent is extended or adjusted under 35 U.S.C. 154(b) by 829 days.

(21) Appl. No.: 11/407,199

(22) Filed: Apr. 20, 2006

(65) Prior Publication Data

US 2006/0238460 A1 Oct. 26, 2006

(30) Foreign Application Priority Data

Apr. 22, 2005 (TW) ..... 94112908 A

(51) Int. Cl.
*G09G 3/30* (2006.01)

(52) U.S. Cl. ..... 345/76; 345/55; 345/78; 345/87; 345/89; 345/98; 345/100; 345/204

(58) Field of Classification Search ..... 345/55, 345/76, 78, 87, 89, 98
See application file for complete search history.

(56) References Cited

U.S. PATENT DOCUMENTS

| | | | | |
|---|---|---|---|---|
| 4,268,148 | A * | 5/1981 | Wakabayashi | 396/388 |
| 5,460,381 | A * | 10/1995 | Smith et al. | 273/238 |
| 6,999,048 | B2 | 2/2006 | Sun et al. | |
| 2004/0174282 | A1 * | 9/2004 | Sun et al. | 341/136 |
| 2004/0263437 | A1 * | 12/2004 | Hattori | 345/76 |

* cited by examiner

*Primary Examiner*—Richard Hjerpe
*Assistant Examiner*—Saifeldin Elnafia
(74) *Attorney, Agent, or Firm*—Birch, Stewart, Kolasch & Birch, LLP

(57) ABSTRACT

A data driving circuit, used to drive display devices, comprises a digital-to-analog current converter (DAC), a reset circuit connected to the output terminal of the DAC for resetting the output potential of the DAC to a specific gray scale potential, and plural stages of data driver units connected to the output terminal of the DAC and the reset circuit to drive data lines of the display devices. Each of the data driver units comprises a sample-holding circuit and a control circuit.

16 Claims, 9 Drawing Sheets

DATA DRIVING CIRCUIT OF DISPLAY DEVICE

FIELD OF THE INVENTION

The present invention relates to a structure of data driving circuit in a current driving display, and more specifically to a circuit that adds a reset circuit to an output terminal of a digital-to-analog current converter to improve the performance of the lowest gray scale.

BACKGROUND OF THE INVENTION

The organic electroluminescence display, known as the organic light emitting diode (OLED) display, is nearly applied to replace the traditional liquid crystal display (LCD) for its superiority in high brightness, fast response time, light weight, compactness, full color, wide view angle range, and low power consumption. The OLED display is also applied to serve the display devices as new generation portable electronic products, such as calculators, personal digital assistants (PDAs), laptops, digital cameras, and mobile phones.

The OLED is a current driving device whose light intensity is depended on the passing current. Currently, OLEDs fabricated in the organic electroluminescence display are disposed in array, and the image signals with different gray scales are obtained by adjusting the driving current of the OLEDs. To drive the OLEDs for generating the image, two types of designs, including a passive matrix and an active matrix, are applied. In the art, the active matrix is preferable for it can meet the requirements of a large-scale panel and can provide a higher resolution.

As shown in FIG. 1, an integrated driving circuit in the current driving display of the prior art is illustrated. The integrated driving circuit is applied to drive a pixel array 100 and comprises a level shifter 112, a digital-to-analog current converter 114 called as a DAC hereinafter, a horizontal shift register 116, a plurality of data driver units 118 and a vertical shift register 120. The data driver units 118 include a plurality of sample-holding switches $SW_1$-$SW_N$ (called as S/H switches hereinafter) and a plurality of sample/holding circuits $S/H_1$-$S/H_N$ (called as S/H circuits hereinafter), wherein the first S/H circuit $S/H_1$ can store or output data to the pixels 11, 12, . . . in column 1 when the S/H switch $SW_1$ is switched on or off, respectively. Similarly, the pixels 21, 22 . . . in column 2 are driven by the S/H switch $SW_2$ and the S/H circuit $S/H_2$, and similar operations occurs for the other S/H switches and the respective S/H circuits.

When the level shifter 112 receives a digital signal, the level shifter 112 adjusts the voltage level of the digital signal and then outputs it to the DAC 114 for converting the digital signal into an analog signal. Then, the horizontal shift register 116 outputs signals $sw_a$, $sw_b$, . . . , and $sw_n$ respectively to the $SW_1$, $SW_2$, . . . , $SW_N$ so as to have the analog signal stored into the $S/H_1$, $S/H_2$, . . . , $S/H_N$ in turn. When one row N of pixels receive a scanning signal and the S/H circuit $S/H_N$ outputs the analog signal to the pixels in column N, the pixel (N, N) is then driven by the analog signal from the S/H circuit $S/H_N$. When the DAC 114 receives the same digital signal of gray scale and converts it into the analog signal, the data driver units 118 can then receive the analog signal outputted from the DAC 114 and thereby the uniformity of the images quality can be enhanced.

However, there is a serious defect of the integrated driving circuit structure in the current driving display shown in FIG. 2. In practice, parasitical capacitors 124*a*, 124*b* . . . , 124*j* and parasitical resistors 122*a*, 122*b* . . . , 122*j* are inevitably formed in the wiring, and they can degrade the performance of gray scale to some extent. The end of the DAC 114 is used to store the electric charge due to the parasitical capacitors. The further the distance from the DAC 114 is, the larger the capacitance of the parasitical capacitor can be. Yet, at the same time, the worse performance of the gray scale will be present. Furthermore, when the display shows the low gray scale immediately after the high gray scale, the influence on the performance of gray scale would be the worst. When the input signal is the high gray scale, the end of the DAC 114 would store the electric charges in the wire due to the parasitical capacitor. After that, the input signal is changed into the low gray scale and the value of the analog current converted from the DAC 114 is small. Normally, the display cannot show the low gray scale easily because the small current is unable to charge or discharge the voltage at the end of the DAC 114 on time.

Please refer to FIG. 3 which shows how the parasitical capacitors influence the integrated driving circuit while the lowest gray scale comes immediately after the high gray scale. In the figure, images of a testing of reciprocally showing the high gray scale and the lowest gray scale are used to illustrate the defect caused by the parasitical capacitor. In subplot A, according to the scan direction from left to right, three blocks are seen to represent the lowest gray scale, the high gray scale, and the lowest gray scale, respectively. In the reign of the right-hand-side lowest gray scale following the middle high gray scale, the electric charges in the parasitical capacitors close to the end of the DAC 114 would degrade the lowest gray scale by generating a gradient phenomenon as shown. Subplot B differs from subplot A by its scan direction, from right to left. Apparently, the parasitical capacitors influence the presentation of lowest gray scale by generating the gradient phenomenon at the reign of the lowest gray scale following the high gray scale. In subplot C of FIG. 3, there are three blocks to illustrate the leading high gray scale, the following lowest gray scale, and the later high gray scale and the scan direction is from left to right. At the reign of the lowest gray scale following the leading high gray scale, the end of the DAC 114 stored the electric charges by the parasitical capacitors causes a non-expectative presentation of lowest gray scale (i.e., a gradient phenomenon). Subplot D is similar to subplot C, but the scan direction is altered from right to left. Again, the parasitical capacitors influence obviously the presentation of lowest gray scale by generating the gradient phenomenon at the reign of the lowest gray scale following the leading high gray scale (left-hand side).

Therefore, the object of the present invention is to make the display able to show the lowest gray scale expectative at the reign of the lowest gray scale following the high gray scale for overcoming the influence of the parasitical capacitors and the parasitical resistors of the circuit in the display.

SUMMARY OF THE INVENTION

The prime objective of the present invention is to improve the performance of display devices, especially in the lowest gray scale (i.e. the zero gray scale), by including a reset circuit at an output terminal of a digital-to-analog current converter. When the input data is the lowest gray scale, the reset circuit is forced to reset the voltage potential of the output terminal of the digital-to-analog current converter to the lowest gray scale potential for showing the black frame of the display devices normally.

In the present invention, a data driving circuit is used to drive at least a display device, which is coupled to the data driving circuit via a pixel circuit and a data line at least. The data driving circuit comprises a digital-to-analog current converter (DAC), a reset circuit and plural stages of data driver units. The DAC receives a digital signal and converts it into an analog current. The reset circuit connected to an output end of the DAC is forced to reset a voltage potential of the output end of the DAC to be a gray scale potential. The data driver units are connected to the DAC and are used for driving the data lines of the display devices. Each stage of the data driver units comprises a sample-holding circuit for copying or refreshing the analog current to a respective current signal that is further outputted to the data lines of display device, and a sample-holding switch connected between the DAC and the sample-holding circuit so as to control ON/OFF of the corresponding stage of the data driver units in storing or refreshing the analog current.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCCRIPTIONS OF THE PREFERRED EMBODIMENT

Figure 1:
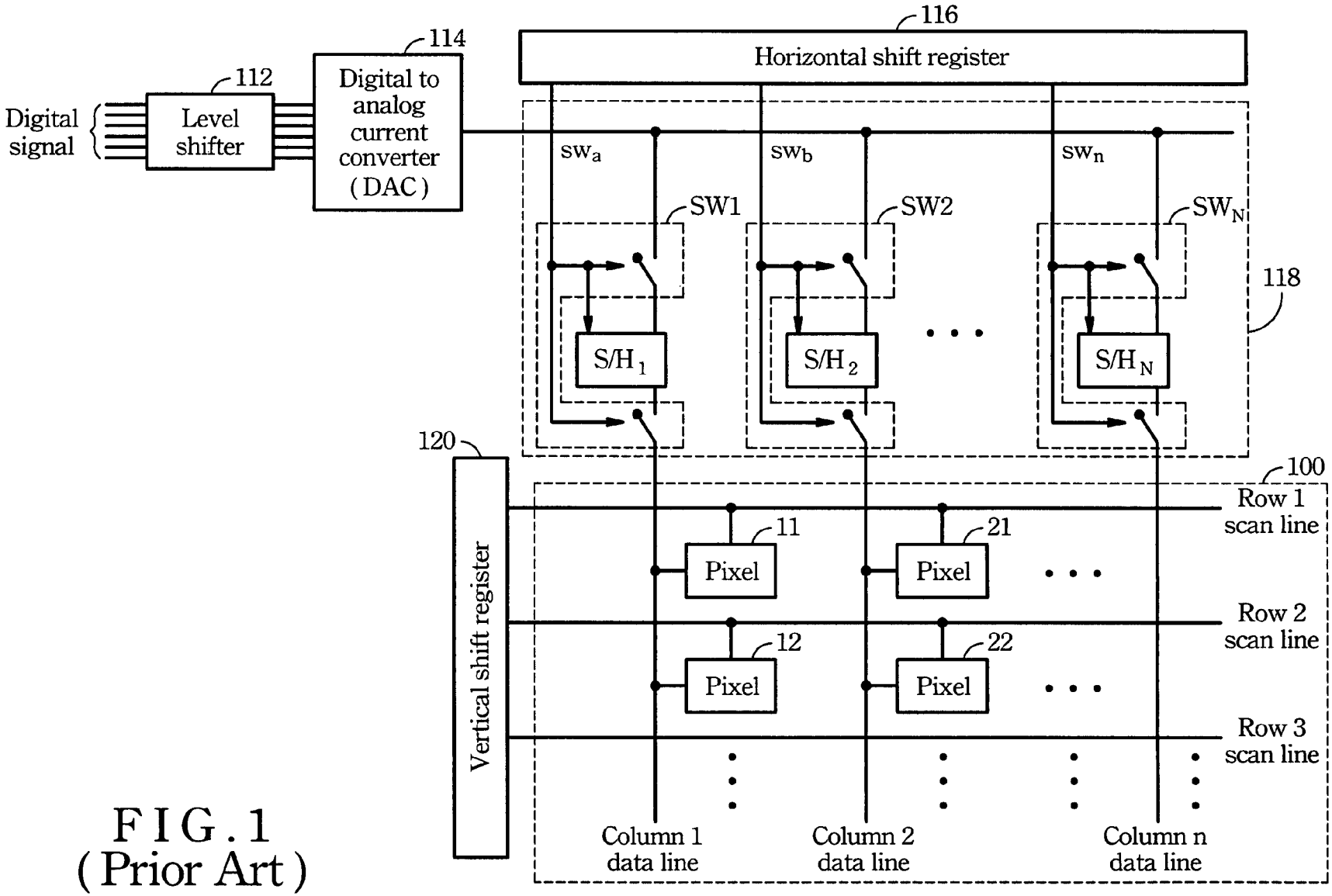
FIG. 1 (Prior Art)
FIG. 1 illustrates an integrated data driving circuit structure in the prior art.
Figure 2:
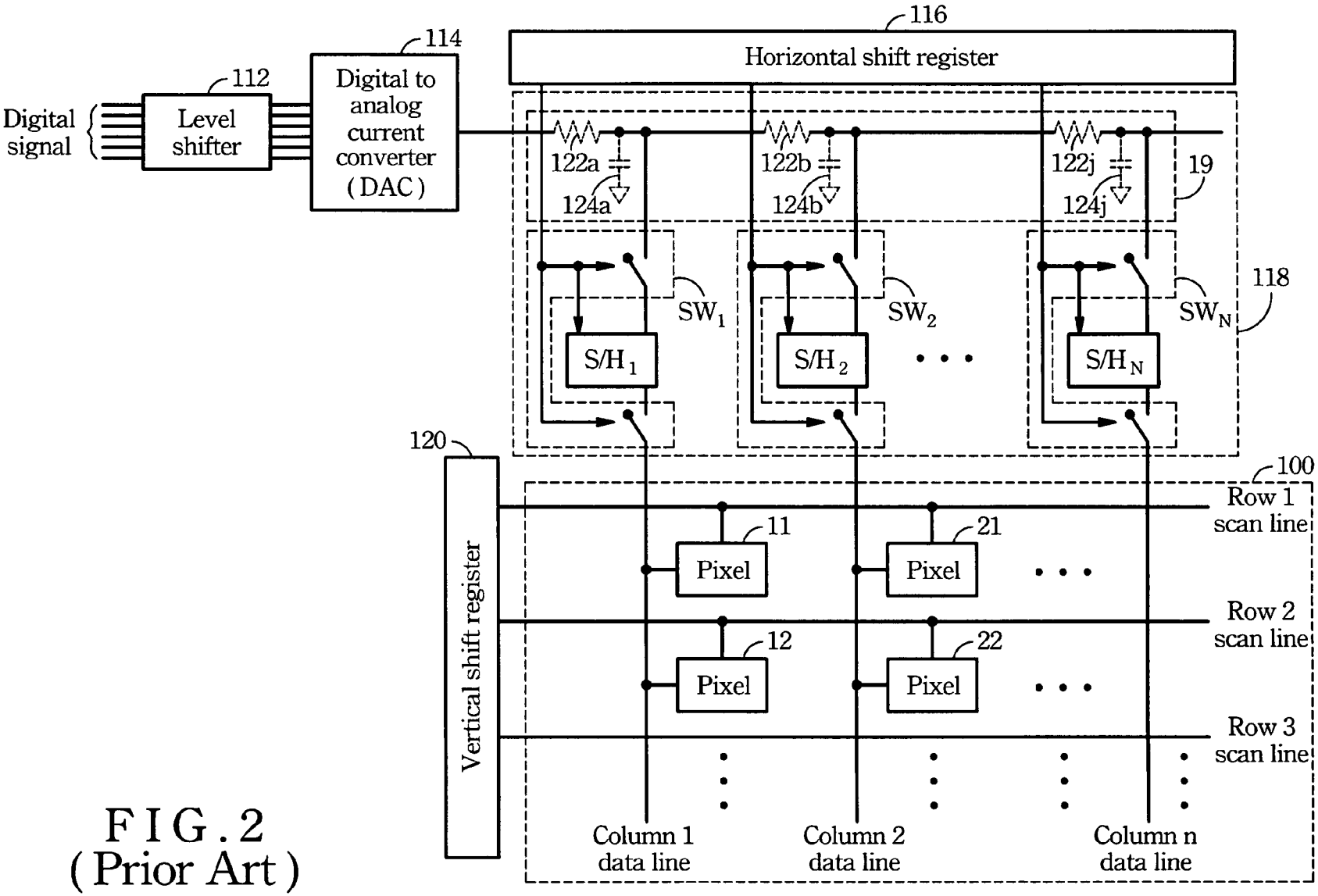
FIG. 2 (Prior Art)
FIG. 2 illustrates an integrated data driving circuit structure comprising parasitical capacitors and parasitic resistors in the prior art.
Figure 3:
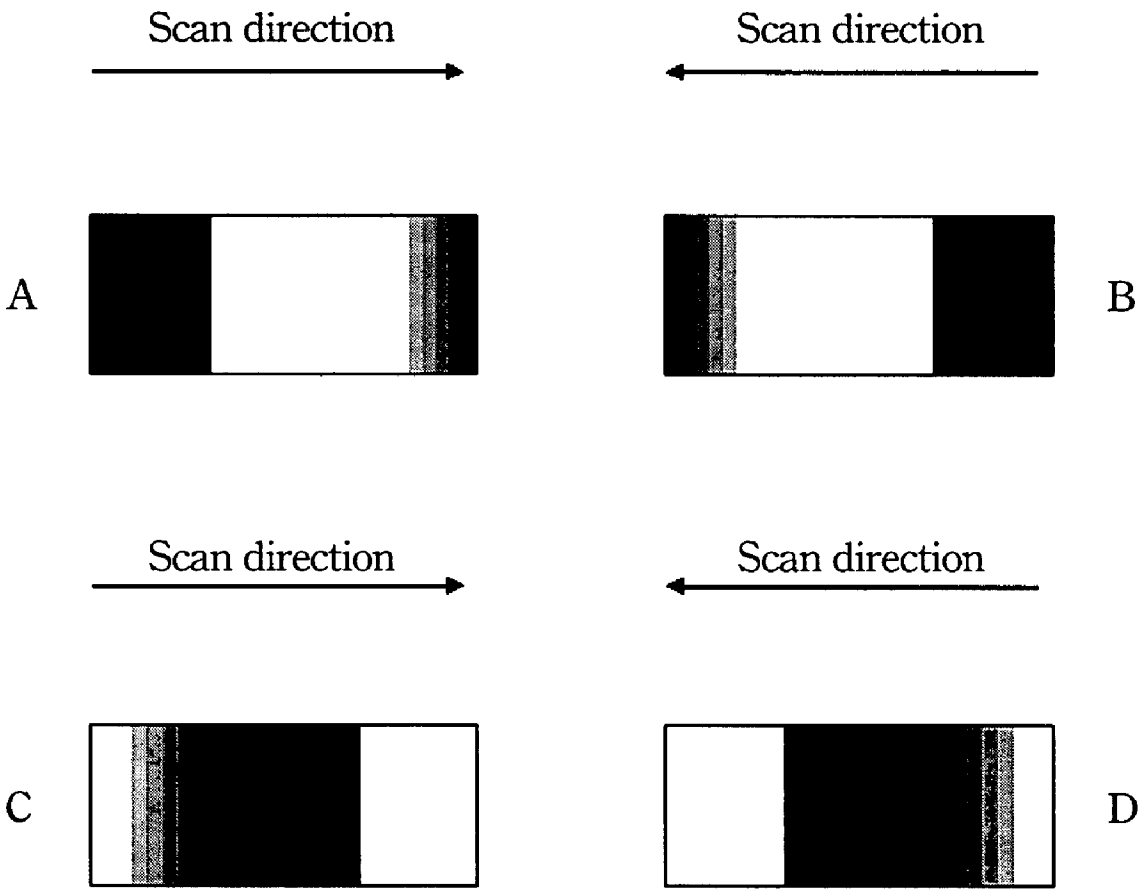
FIG.3 (Prior Art)
FIG. 3 illustrates typical examples demonstrating how the parasitical capacitors influence the integrated driving circuit in the prior art.
Figure 4:
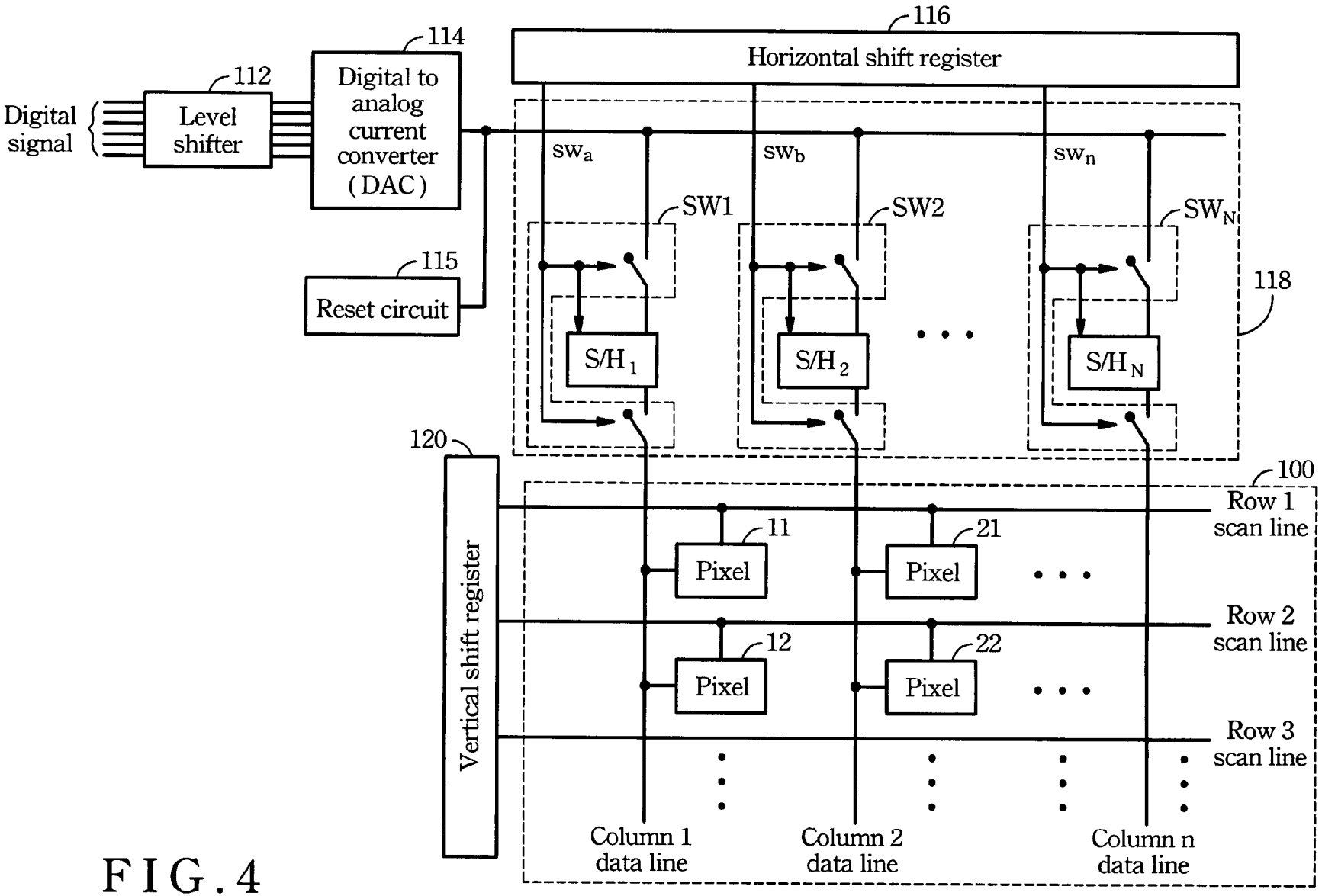
FIG. 4 illustrates one embodiment of a data driving circuit structure of the present invention.

Please refer to FIG. 4, which shows a preferred data driving circuit structure according to the present invention. The data driving circuit is used to drive a current driving display module. The current driving display module comprises a substrate, a plurality of display devices formed on an upper surface of the substrate, and a backplane mounted on the upper surface of the substrate.

The data driving circuit for driving a pixel matrix 100 comprises a level shifter 112, a digital-to-analog current converter (DAC) 114, a reset circuit 115, a horizontal shift register 116, plural stages of data driver units 118, and a vertical shift register 120. The digital-to-analog current converter 114 can be a current steering type converter. Each stage of the data driver units includes a sample-holding switch $SW_N$ (called as S/H switch hereinafter) and a sample-holding circuit $S/H_N$ (called as S/H circuit hereinafter). A first column of pixels 11, 12, . . . , and so on are controlled by the S/H switch $SW_1$ who can be switched on or off to permit operation of storing or outputting the data to the S/H circuit $S/H_1$. A second column of pixels 21, 22, . . . , and so on are controlled by the S/H switch $SW_2$ who can be switched on or off to permit the data to be stored or outputted to the S/H circuit $S/H_2$. Similar operations can also be carried out to the other columns of the pixel matrix 100.

The reset circuit 115 is forced to reset the potential of the output terminal of the DAC 114 to be a specific gray scale potential $V_{RESET}$ when a digital signal is a lowest gray scale. It means that, at this moment, the potential of the output terminal of the DAC 114 would be equal to the lowest gray scale potential.

Figure 5A:
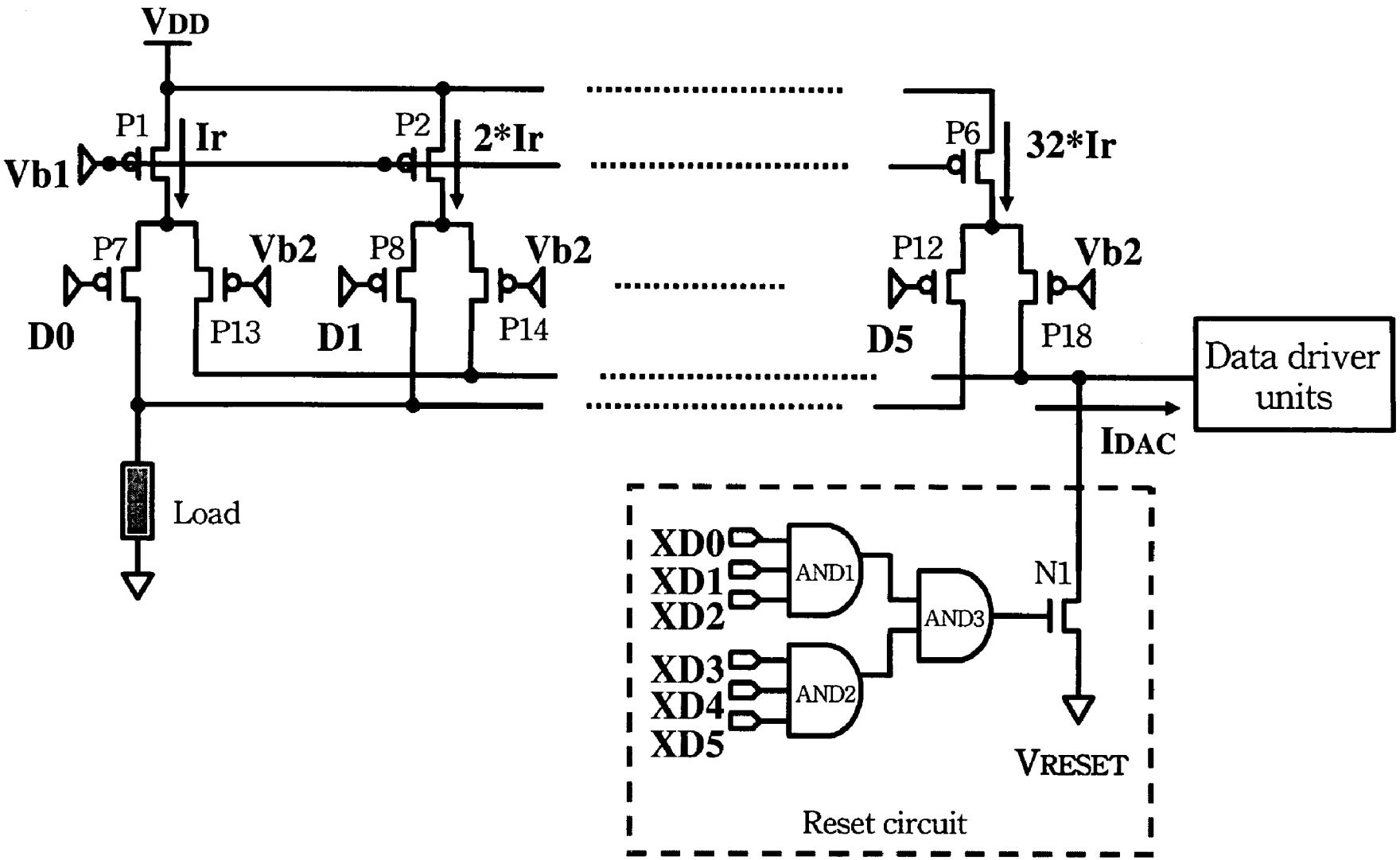
FIG. 5A~B illustrate one embodiment of a reset circuit and a DAC circuit structure of the present invention.

Please refer to FIG. 5A, which shows a preferred digital-to-analog current converter and a preferred reset circuit according to the present invention. Transistors P1 to P6 are used to produce reference currents corresponding to the lowest bit $D_0$ to the highest bit D5, respectively. All of the six transistors P1 to P6 are driven by the same bias voltage Vb1, and the width-to-length ratio (W/L) of the channel in each above transistor increases in a geometric progression way with respect to the position of the bit. That is to say that the value of the reference currents is ranged form the smallest current Ir ($2^0$×Ir) to the biggest 32*Ir ($2^5$×Ir).

The transistors P1 to P6 are connected respectively to the sources of transistors P7 to P12 and also the sources of transistors P13 to P18, such that six groups of transistors are made to receive six bits of digital signals. In each group, the drain of the transistor Pn (n=1, 2, 3, 4, 5, or 6) is connected to the source of the transistor Pn+6 and the source of the transistor Pn+12. The transistors P7 to P12 received the lowest bit $D_0$ to the highest bit $D_5$ respectively for driving the transistors P7 to P12 to produce the currents collected into the load, and the transistors P13 to P18 are driven by the same bias voltage Vb2 to produce the remainder currents responsive to the currents from the transistors P7 to P12. The remainder currents are collected to an analog current $I_{DAC}$ flowing from the DAC circuit into the data driver units 118.

The reset circuit is a logic circuit composed of three AND gates AND1, AND2, AND3 and an NMOS transistor N1. The AND gates AND1, AND2 receive and calculate the inverse digital signals $XD_0$~$XD_5$ and further output the calculated result to the AND gate AND3. The AND gate AND3 processes further calculation and then outputs a respective signal to the NMOS transistor N1 so as to turn on or turn off the NMOS transistor N1.

When the display shows the lowest gray scale, the digital signals $D_0$~$D_5$ are all represented low levels and the inverse digital signals $XD_0$~$XD_5$ are all represented high levels (typically, the low level is 0 and the high level is 1). The AND gates AND1 and AND2 of the reset circuit receive the inverse digital signals $XD_0$~$XD_5$(=1), and the AND gate AND3 outputs a high level signal to drive the NMOS transistor N1. The NMOS transistor N1 is then turned on by the high level signal, and the voltage (potential) of the output terminal of the DAC circuit is equal to a voltage $V_{RESET}$ of a lowest gray scale. The reset circuit is forced to reset the voltage potential of the output terminal of the DAC circuit to the lowest gray scale potential so as to charge or discharge the parasitical capacitors for showing the black frame of display devices normally.

When the display shows other gray scales (non-lowest gray scale), it implies that at least one of the digital signals $D_0$~$D_5$ is not represented by 0. The AND gates AND1 and AND2 of the reset circuit receive at least one non-zero inverse digital signal, and the AND gate AND3 outputs a low level signal to the NMOS transistor N1. The NMOS transistor N1 is then turned off by the low level signal, and the voltage (potential) of the output terminal of the DAC circuit is now not altered by the reset circuit.

Figure 5B:
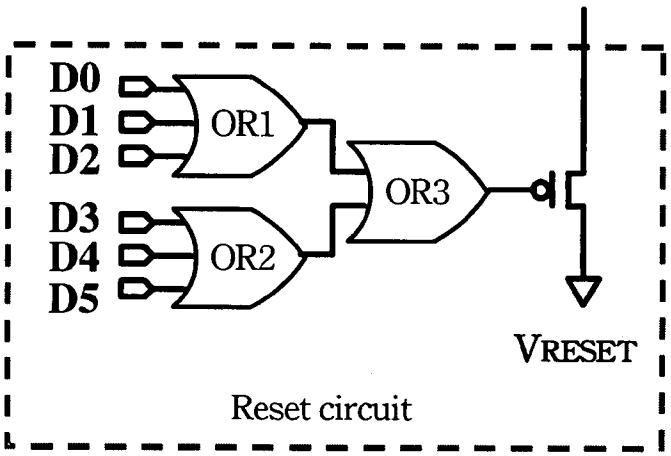

Please refer to FIG. 5B, which shows another preferred reset circuit according to the present invention. The reset circuit is a logic circuit composed of three OR gates OR1, OR2, OR3 and a PMOS transistor P1. The OR gates OR1, OR2 are all used to receive and then calculate the digital signals $D_0$~$D_5$, and the calculated result of the OR gates are forwarded to the OR gate OR3. Then, the OR gate OR3 can perform further processing and output a signal to control the PMOS transistor P1.

The reset circuit is composed of a plurality of AND or OR gates and a transistor. In some other situations, the reset circuit can also be composed of any kind of logic gates and electrical components to obtain the same function as described in the above two embodiments.

Figure 6A:
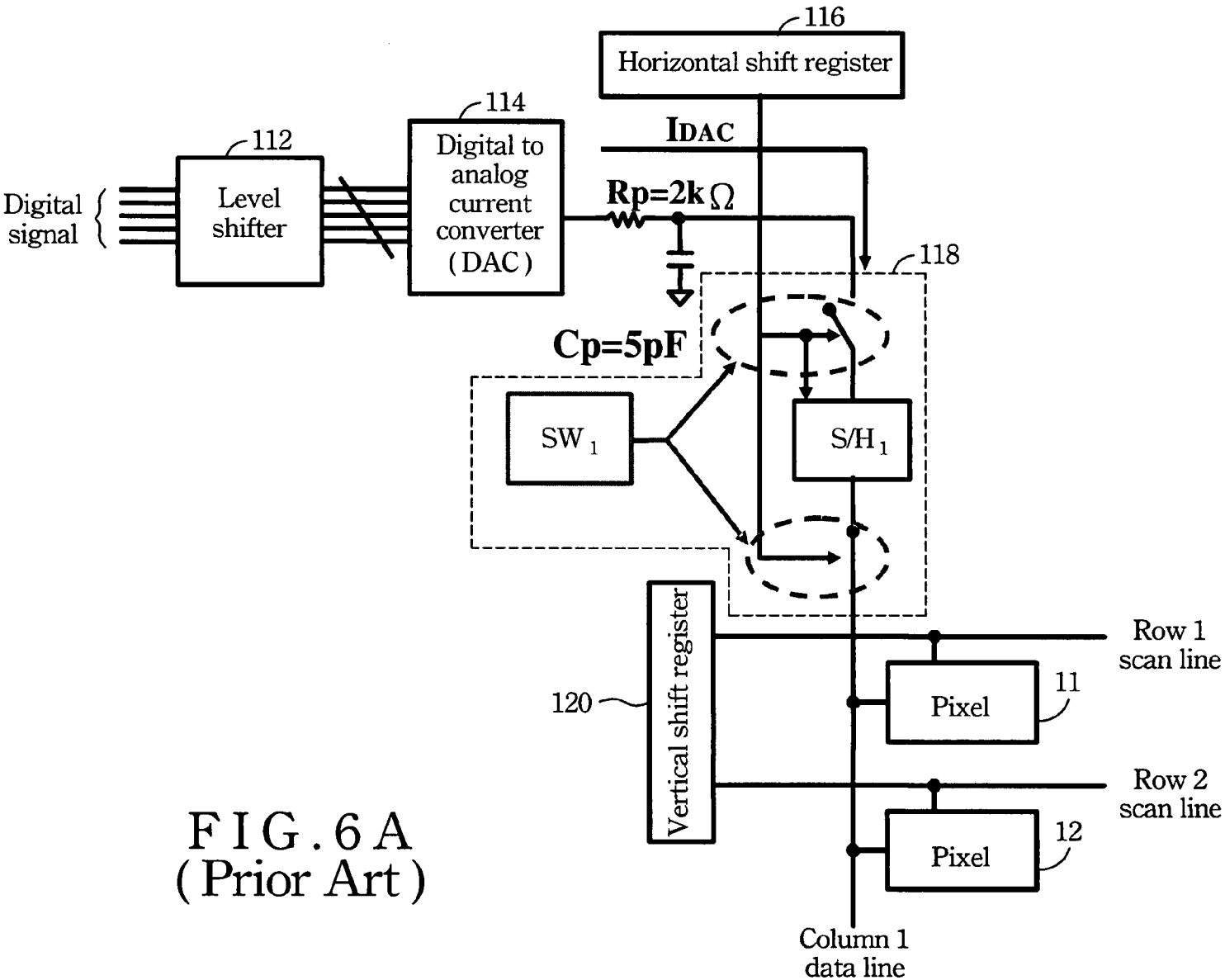
FIG. 6A (Prior Art)
FIG. 6A illustrates a data driving circuit structure in the prior art and FIG. 6B illustrates one embodiment of a data driving circuit structure of the present invention.

Please refer to FIG. 6A, which shows a conventional data driving circuit. The data driving circuit is used to drive the pixel matrix (showing only one column of pixels 11, 12, . . . ). The data driving circuit includes a level shifter 112, a DAC 114, a horizontal shift register 116, plural stages of data driver units 118 (showing one of the stages), and a vertical shift register 120. To simulate a testing upon the data driving circuit by having the parasitical capacitor $C_P$=5pF and the parasitical resistor $R_P$=2kΩ, the testing result is listed as Curve C in FIG. 7.

Figure 6B:
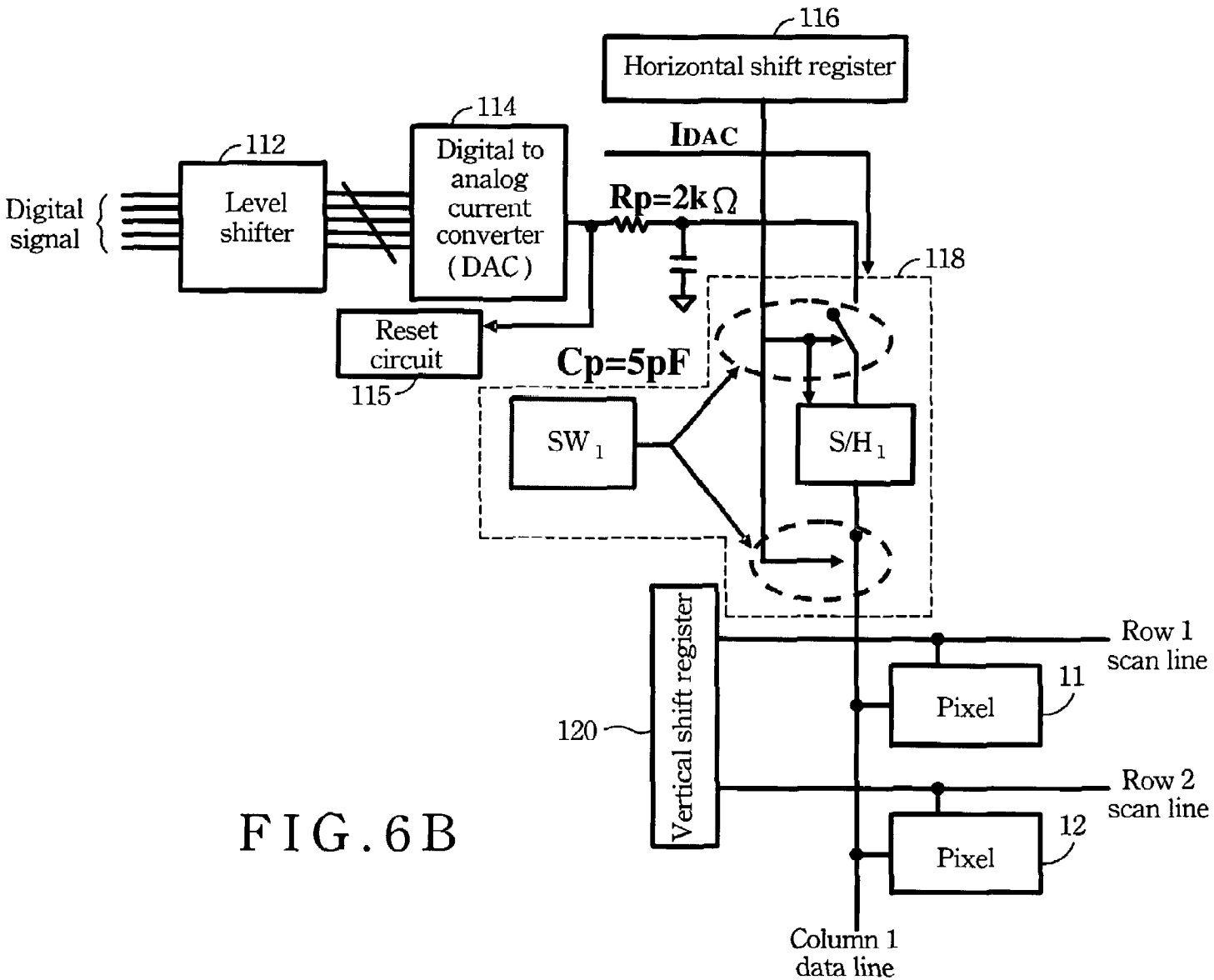

Please refer to FIG. 6B, which shows a data driving circuit according to the present invention. The data driving circuit is used to drive the pixel matrix (showing only one column of pixels 11, 12 . . . ). The data driving circuit includes a level shifter 112, a DAC 114, a reset circuit 115, a horizontal shift register 116, plural stages of data driver units 118 (showing one of the stages), and a vertical shift register 120. After a similar testing upon the circuit of FIG. 6B as the foregoing test upon the circuit of FIG. 6A by assigning $C_P$=5pF and $R_P$=2kΩ, the result from testing the circuit of the present invention is listed as Curve D of FIG. 7.

Figure 7:
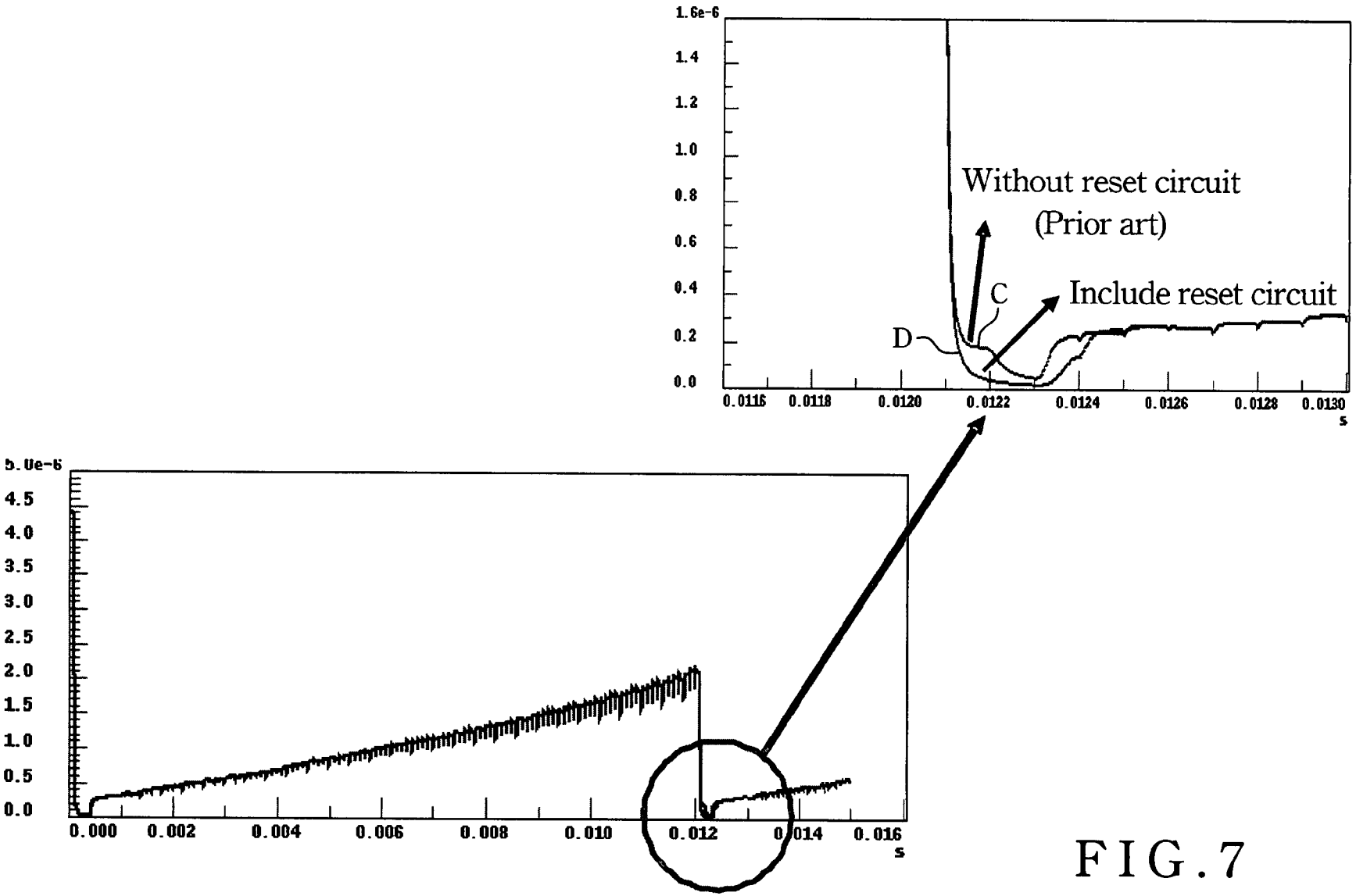
FIG. 7 illustrates the relation between the gray scale current of display and time of the present invention.

Please refer to FIG. 7, which shows the relationships between the gray scale current (in Ampere) of the display and time (in second). In the enlarged pop-up at the upper right corner of FIG. 7, it shows a miniature of the changes in gray scale currents for Curves C and D at the conjunction of the lowest gray scale current following the highest gray scale current. As shown in Curve C, the effect of the parasitical resistors and the parasitical capacitors is remarkable in the conventional circuit, where the lowest gray scale current cannot be down to zero. The phenomenon in Curve C implies that the performance of gray scales in the conventional design of FIG. 6A is poor, especially for a situation of having the lowest gray scale following the highest gray scale, and thus the discrimination between the gray scales in display would be vague. Compared Curve D with Curve C, an obvious better performance of the gray scales is present, where the lowest gray current touches zero at the moment while the lowest gray scale is met after the highest gray scale, and the discrimination of the gray scale in display can be expected. Apparently, the reset circuit in the present invention can lessen the influence of the parasitical capacitors and the parasitical resistors in the circuit so as to have a satisfied lowest gray scale performance in display.

The reset circuit of the driving circuit in the present invention provides a better performance in the lowest gray scales of the display. It can become expectable that the black frame of display devices, especially for meeting the lowest gray scale following the highest gray scale, can be clear, and the gradient phenomenon like the conventional data driving circuit can be waived in the device having the circuit according to the present invention.

Although the present invention and its advantages have been described in detail, as well as some variations over the disclosed embodiments, it should be understood that various other changes, substitutions and alterations can be made herein without departing from the spirit and scope of the invention as defined by the appended claims.

What is claimed is:

1. A data driving circuit, used to drive at least a display device and connected to said display device via a plurality of pixel circuits and data lines, comprising:

a digital-to-analog current converter for receiving a digital signal and further converting the digital signal into an analog current;

a reset circuit directly connected to an output terminal of said digital-to-analog current converter to reset a potential of said output terminal of said digital-to-analog current converter to a specific gray scale potential; and plural stages of data driver units, connected to said digital-to-analog current converter and said reset circuit, for driving a plurality of said data lines of said display device, and each of the stages further comprising:

a plurality of sample-holding circuits used to copy or refresh current signals to said data lines; and a plurality of sample-holding switches, connected to said digital-to-analog current converter and said sample-holding circuits, for controlling switching of said data driver units in storing or refreshing said analog current, wherein said reset circuit is electrically connected between said digital-to-analog current converter and said data driver units.

2. The data driving circuit of claim 1 further comprising a level shifter connected to said digital-to-analog current converter so as to adjust a voltage level of said digital signal.

3. The data driving circuit of claim 1 further comprising a shift register for outputting a plurality of switch signals to said sample-holding switches of said data driver units, wherein each of said switch signals is used to control said switching of said data driver units.

4. The data driving circuit of claim 1, wherein said display device is selected from the group of an OLED, a PLED, and the other current driving display device.

5. The data driving circuit of claim 1, wherein said digital-to-analog current converter is a current steering type converter.

6. The data driving circuit of claim 1, wherein said reset circuit is composed of plural logic gates and electric devices.

7. The data driving circuit of claim 1, wherein said reset circuit is composed of AND gates and a transistor.

8. The data driving circuit of claim 1, wherein said reset circuit is composed of OR gates and a transistor.

9. The data driving circuit of claim 1, wherein said specific gray scale potential is a lowest gray scale potential.

10. The data driving circuit of claim 1, wherein said reset circuit is a logic circuit composed of a first, a second, a third AND/ OR gates and an transistor, the first and the second AND/ OR gates receive and calculate the inverse digital signals and further output the calculated result to the third AND/ OR gate.

11. A current driving display module comprising:

a substrate;

plural of display devices fabricated on an upper surface of said substrate wherein each of the display devices is coupled to a plurality of data lines via a plurality of pixel circuits;

a data driving circuit, used to drive said plural display devices and connected to said plural display devices via said pixel circuits and said data lines, including:

a digital-to-analog current converter for receiving a digital signal and further converting the digital signal into an analog current;

a reset circuit connected to an output terminal of said digital-to-analog current converter to reset the potential of said output terminal of said digital-to-analog current converter to a specific gray scale potential; and plural stages of data driver units, connected to said digital-to-analog current converter and said reset circuit, for driving said data lines of said display device, each of the stages further comprising:

a plurality of sample-holding circuits used to copy or refresh current signals to said data lines; and a plurality of sample-holding switches, connected to said digital-to-analog current converter and said sample-holding circuits, for controlling switching of said data driver units in storing or refreshing said analog current; and a backplane mounted on said upper surface of said substrate, wherein said reset circuit is not directly connected to said data lines.

12. The current driving display module of claim 11, wherein said current driving display module is selected from the group of an OLED display module, a PLED display module, and the other current driving display module.

13. The current driving display module of claim 11, wherein said plural display devices is controlled by said current signal from said data driving circuit to show all kinds of gray scales.

14. The current driving display module of claim 11, wherein said digital-to-analog current converter is a current steering type converter.

15. The current driving display module of claim 11, wherein said specific gray scale potential is a lowest gray scale potential.

16. The current driving display module of claim 11, wherein said reset circuit is a logic circuit composed of a first, a second, a third AND/ OR gates and an transistor, the first and the second AND/OR gates receive and calculate the inverse digital signals and further output the calculated result to the third AND/OR gate.

* * * * *